US006772445B2

(12) United States Patent
Yeager

(10) Patent No.: US 6,772,445 B2
(45) **Date of Patent: *Aug. 10, 2004**

(54) COOLING BRACELET

(76) Inventor: Benjamin Yeager, 1806 E. Silva St., Long Beach, CA (US) 90807

( * ) Notice: Subject to any disclaimer, the term of this patent is extended or adjusted under 35 U.S.C. 154(b) by 0 days.

This patent is subject to a terminal disclaimer.

(21) Appl. No.: 09/683,378

(22) Filed: Dec. 19, 2001

(65) Prior Publication Data

US 2003/0110549 A1 Jun. 19, 2003

(51) Int. Cl.[7] ..... A41D 20/00
(52) U.S. Cl. ..... 2/170; 62/259.3; 607/108
(58) Field of Search ..... 2/170, 174, 311, 2/312, 208, DIG. 11, 171.2, 162, 160; 607/96, 108, 114, 109, 111, 112; 62/259.3; 63/21, 3, 3.1, 3.2

(56) References Cited

U.S. PATENT DOCUMENTS 2,219,277 A * 10/1940 Kaufmann ..... 62/259.3
4,742,581 A * 5/1988 Rosethal ..... 2/181
4,854,319 A * 8/1989 Tobin ..... 607/96
5,119,513 A * 6/1992 McKay ..... 2/181
5,623,731 A * 4/1997 Ehrgott et al. ..... 2/160
5,812,500 A * 9/1998 Webb, Jr. ..... 368/282
5,956,963 A * 9/1999 Lerner ..... 62/259.3
6,139,486 A * 10/2000 Matuszewski et al. ..... 600/15
6,149,617 A * 11/2000 McNally et al. ..... 602/62
D435,911 S * 1/2001 Yeager ..... D24/206
6,173,866 B1 * 1/2001 Taylor, Jr. et al. ..... 222/175

* cited by examiner

*Primary Examiner*—Gloria M. Hale
(74) *Attorney, Agent, or Firm*—Michael L. Greenberg, Esq.; Greenberg & Lieberman

(57) ABSTRACT

A cooling bracelet having a hollow chamber for holding a frozen liquid such as water. The cooling bracelet has a hollow chamber with a plug so the user may easily refill the hollow chamber with a freezable liquid and freeze the bracelet for cooling purposes. The cooling bracelet also has a detachable watch face, which is attached by hook and loop material to the cooling bracelet, on the opposite side from the hollow member holding frozen liquid. The cooling bracelet has a stretchable band so any size wrist can use the cooling bracelet. The stretchable band allows the user to slide the cooling bracelet over the hand to the wrist.

16 Claims, 1 Drawing Sheet

COOLING BRACELET

BACKGROUND OF INVENTION

Athletes and outdoor workers face the elements of being outside and participating in strenuous activity. During summer months, this can lead to severe dehydration and heat stroke without proper care during physical activity. Many athletes and outdoor workers use ice, wet cloths, and cooling packs to keep themselves at comfortable temperatures during the heat of the day. Also cooling packs can be used to relieve pain and swelling from sports related or chronic muscle and joint injuries.

There are bracelets on the market that have gel packets so that the user may freeze the gel and the bracelet is cool for a set amount of time. Gel packets have an inherent problem due to rupture after repeated freezings. There are also sweat band type bracelets made of terry cloth material that can be moistened and worn. However the sweat band bracelets would dry quickly in excessive heat and would not have the capacity to be frozen and worn due to the problems of lack of elasticity once frozen, creating problems for applying the bracelet to the wrist once frozen.

U.S. Pat. No. 6,275,996 issued to Redwood, et al., on Aug. 21, 2001, shows articles with removable elements. Redwood's invention is unlike the present invention because it has a removable component for comfort such as copper, magnets, blood pressure monitoring systems, foam or gel packs. Also, the present invention does not have a compartment for adding water and freezing, and in the watch embodiment it does not have a detachable face from the bracelet or strap. Additionally, Redwood's invention has many different embodiments and purposes for its removable components and is not solely for the cooling of the wrist.

U.S. Pat. No. 6,149,617 issued to McNally, et al., on Nov. 21, 2000 shows a tennis elbow band and method. McNally's invention is unlike the present invention because it is intended for use on the elbow only not the wrist, and it has heating properties for therapy of tennis elbow as well. Also, the packets are frozen separately from the bracelet and are inserted into the interior of the bracelet instead of freezing the entire bracelet. Additionally, McNally's invention does not have a detachable watch face.

U.S. Pat. No. 5,593,769, issued to Wolf, et al., on Jan. 14, 1997, for a polyurethane pad covering for gel filled articles. Wolf's invention is unlike the present invention because it is gel filled, it is not intended for wear on the wrist, and it is primarily a system for allowing people to use gel filled articles without the gel contacting their skin.

U.S. Pat. No. 5,165,402 issued to McCoy on Nov. 24, 1992, shows a therapeutic wrap. McCoy's invention is unlike the present invention because it is an adjustable hook and loop fabric with a compartment for a hot or cold gel pack, does not have a detachable watch face, and does not have a compartment to add water and freeze the bracelet for cooling properties.

U.S. Pat. No. 5,035,003 issued to Rinehart on Jul. 30, 1991 shows a liquid heat transfer glove. Rinehart's invention is unlike the present invention because it is a glove or glove lining used for heating a hand and does not provide a bracelet for cooling one's wrist. Rinehart's invention also does not have a hollow core for freezing water to cool oneself, and it does not have a a detachable watch face, or arm band mechanism.

Therefore a need has been established for a bracelet that may be filled with water and frozen for cooling one's wrist, further including a detachable watch face.

SUMMARY OF INVENTION

The present invention is a bracelet with cooling capabilities. The bracelet has hollow member that can hold a freezable liquid such as water. The user has a removable cap that covers the opening of the bracelet, so that they may remove the cap and put water in the hollow interior and freeze. The bracelet may be emptied and refrozen as many times as is necessary. There is also a detachable watch face to the bracelet so the user may wear the bracelet as a watch and still be cooled by the interior ice.

The bracelet is made of a flexible, metal alloy material that allows the coolness of the interior ice to escape, yet is thick enough to protect the user's skin from possible ice burn. The metal alloy can be of any composition, which does not heat or cool in ambient temperature. Once frozen the bracelet will keep a cool temperature for several hours before all of the ice is melted and it should be refrozen. A user may temper the time that the bracelet is cool, by tempering the amount of water injected into the bracelet before freezing. A larger amount of water will create a longer melting or cooling period, and a smaller amount of water will create a shorter melting or cooling time.

The cooling bracelet can be manufactured in separate wrist sizes, or in alternate embodiments the bracelet can be manufactured to stretch to fit different wrist sizes.

The hollow member is located on the underside of the bracelet, and expands ⅓ the total length of the bracelet. The hollow section, when filled with frozen liquid, should be placed on the underside of the wrist, directly below the palm for maximum cooling properties.

The detachable watch face is attached to the cooling bracelet via hook and loop fastener material. The detachable watch face is attached to the cooling bracelet on the opposite side of from the hollow member. The detachable watch face is protected from moisture, due to the distance from the hollow member and the layers of hook and loop material.

The hollow member is constructed of a rubber or plastic material to increase the durability of the hollow member and to decrease wicking capabilities as the frozen liquid melts. The hollow member has a plug or stopper that is constructed of a rubber or other pliable material to constrict and expand as necessary. The plug can be totally removable, or attached by a hinged member or a small cord. The hollow member will allow the water or other liquid to cool the user for from one to two hours before totally melted.

DETAILED DESCRIPTION

Figure 1:
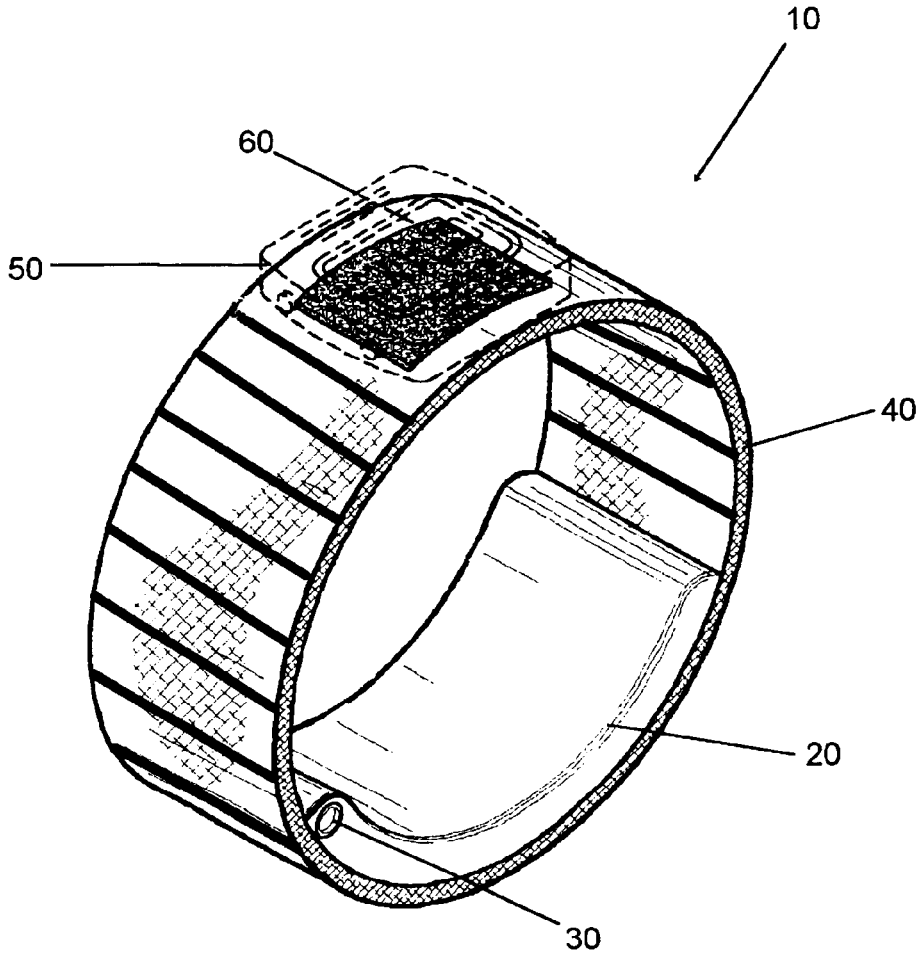
FIG. 1 shows an environmental view of the present invention.

The present invention is a cooling bracelet having a hollow member, a plug for the hollow member, a stretchable band, hook and loop fastener material, and a detachable watch face. The hollow member can be filled with any freezable liquid such as water. The freezable liquid is contained in the hollow member by use of a plug that is made of a pliable material. The detachable watch face removably attaches to the stretchable band through use of the hook and loop fastener material.

In FIG. 1, there is an environmental view of the cooling bracelet (10). The cooling bracelet (10) has a hollow member (20) on the interior side of the stretchable band (40). The hollow member (20) extends ⅓ the length of the entire stretchable band (40). The hollow member (10) is made of a rubber or plastic material and can hold any fluid. The hollow member (20) can be filled with water and frozen to activate the cooling properties of the bracelet (10). The hollow member (20) has a plug (40) which removably attaches to the hollow member (20) through a hole. The plug (30) holds the liquid in the interior of the hollow member (20) during the freezing and thawing of the liquid.

The stretchable band (40) is preferably constructed of a metal alloy material wherein there are two layers (not shown) which work together in a conventional manner to allow the band (40) to expand and contract depending on the wrist size of the user. In other embodiments of the cooling bracelet (10), the stretchable band (40) can be constructed of any other stretchable material such as spandex, stretchable plastic, etc. Also, the band (40) can be constructed in different sizes, and in these embodiments would not need to be stretchable in nature. The stretchable band (40) communicates on its interior side and with the hook and loop fastener material (60). The hook and loop fastener material (60) has a receiving side and attaching side. The receiving side (not shown) is attached to the stretchable band (40), and the attaching side (not shown) is fixedly attached to the underside of the detachable watch face (50). The receiving side (not shown) and the attaching side (not shown) of the hook and loop fastener material (60) are the means for removable attachment of the detachable watch face (50).

The detachable watch face (50) in this embodiment has a digital operational mechanism, but in separate embodiments could be a watch that is wound for operation of gears and telling time. The hook and loop fastener material (60) and stretchable band (40) separate the detachable watch face (50) from any moisture that may wick from the hollow member (20). The hollow member (20) is constructed of a rubber or plastic material which is resistant to wicking, however should wicking occur the detachable watch face (50) is separated by several layers from the wicked moisture.

The user can easily fill the hollow member (20) of the cooling bracelet (10) by removing the plug (30) from the communicating hole (not shown) in the hollow member (20) and filling with water from a pitcher, or faucet. The user can then place the cooling bracelet (10) in the freezer and the water or other freezable liquid will freeze in a short amount of time. In separate embodiments the hollow member (20) can be constructed to be removed from the stretchable band (40).

The cooling bracelet (10) can be used by athletes, outdoor workers, and any other person who is exposed to extreme heat. The cooling bracelet (10) is placed over the wrist by the user placing their hand through the stretchable band (40). The hollow member (20) when filled with frozen liquid (not shown) is placed on the underside of the user's wrist at the base of the palm. In this position the cooling bracelet (10) has maximum cooling possibilities, due to the close proximity to the veins in the wrist. A user can also take the cooling bracelet (10) in a cooler or thermos to keep the bracelet (10) frozen until the heat of the day, usually mid afternoon, and use the bracelet as needed. The detachable watch face (50) can have a time face, date function, and timing function as any conventional watch. In separate embodiments of the present invention, the detachable watch face (50) could be fixedly attached to the stretchable band (40).

The present invention is not limited to the sole embodiments above, but instead includes any and all of the embodiments in the following claims.

What is claimed is:

1. A cooling bracelet comprising:

a stretchable band;

a hollow member, fixedly attached to said stretchable band and having the capability to hold liquid;

a plug removably attached to said hollow band;

a fastening means fixedly attached to said band;

a watch face, removably connected to said fastening means; and said stretchable band, said hollow member holding liquid, said plug, and said fastening means having the capability to be frozen for cooling purposes.

2. A cooling bracelet as claimed in claim 1 wherein said watch includes functioning timepiece.

3. A cooling bracelet comprising:

a stretchable band;

a hollow member, fixedly attached to said stretchable band and having the capability to hold liquid;

a plug removably attached to said hollow member;

a watch face, fixedly connected to said band; and said stretchable band; said hollow member holding liquid, said plug, and said watch face having the capability to be frozen for cooling purposes.

4. A cooling bracelet as claimed in claim 3 wherein said watch face includes functioning timepiece.

5. A cooling bracelet comprising:

a band;

a hollow member fixedly attached to said band and having the capability to hold liquid;

a fastening means fixedly attached to said band;

a watch face, removably connected to said fastening means and wherein said band, said hollow member holding liquid and said fastening means have the capability to be frozen for cooling a wearer when worn.

6. A cooling bracelet as claimed in claim 5 comprising a plug removably attached to said hollow member.

7. A cooling bracelet as claimed in claim 6 wherein said watch face includes functioning timepiece.

8. A cooling bracelet as claimed in claim 5 wherein said band is stretchable.

9. A cooling bracelet as claimed in claim 8 wherein said watch face includes functioning timepiece.

10. A cooling bracelet as claimed in claim 5 wherein said watch face includes functioning timepiece.

11. A cooling bracelet comprising:

a band;

a hollow member fixedly attached to said band and having the capability to hold liquid;

a watch face fixedly connected to said band; and wherein said band, said hollow member holding liquid and said watch face have the capability to be frozen for cooling a wearer when worn.

12. A cooling bracelet as claimed in claim 11 wherein said hollow member includes a plug removably attached to said hollow member.

13. A cooling bracelet as claimed in claim 12 wherein said watch face includes functioning timepiece.

14. A cooling bracelet as claimed in claim 11 wherein said band is stretchable.

15. A cooling bracelet as claimed in claim 14 wherein said watch face includes functioning timepiece.

16. A cooling bracelet as claimed in claim 14 wherein said watch face includes functioning timepiece.

* * * * *